US007065799B2

(12) United States Patent
Grilliot et al.

(10) Patent No.: US 7,065,799 B2
(45) Date of Patent: Jun. 27, 2006

(54) PROTECTIVE GARMENT HAVING NON-LAMINATED, LIQUID-IMPERVIOUS OR FLUID-IMPERVIOUS LAYERS, WHICH PROVIDE REDUNDANT PROTECTION

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 337 days.

(21) Appl. No.: 10/717,397

(22) Filed: Nov. 19, 2003

(65) Prior Publication Data

US 2005/0102740 A1 May 19, 2005

(51) Int. Cl.
*A41D 13/12* (2006.01)

(52) U.S. Cl. ..... 2/456

(58) Field of Classification Search ..... 2/102, 2/456, 462–465, 455, 94, 108, 2.5, 69, 69.5, 2/79, 227, 275, 457
See application file for complete search history.

(56) References Cited

U.S. PATENT DOCUMENTS 2,976,539 A * 3/1961 Brown, Jr. ..... 2/93
3,863,343 A * 2/1975 Malmin ..... 433/229
4,272,851 A 6/1981 Goldstein
4,855,178 A 8/1989 Langley
4,864,654 A 9/1989 Schriver et al.
4,924,525 A 5/1990 Bartasis
4,935,308 A 6/1990 Guerra et al.
4,992,335 A 2/1991 Guerra et al.
5,019,453 A 5/1991 Guerra
5,082,721 A 1/1992 Smith, Jr. et al.
5,169,697 A 12/1992 Langley et al.
5,491,022 A 2/1996 Smith
5,494,720 A 2/1996 Smith et al.
5,692,935 A 12/1997 Smith
5,784,717 A * 7/1998 Singer ..... 2/79
5,869,193 A 2/1999 Langley
5,948,708 A 9/1999 Langley
6,302,993 B1 10/2001 Smith et al.
6,364,980 B1 4/2002 Smith et al.
6,408,440 B1 * 6/2002 Phillips ..... 2/102

* cited by examiner

*Primary Examiner*—Tejash Patel
(74) *Attorney, Agent, or Firm*—Wood, Phillips, Katz, Clark & Mortimer

(57) ABSTRACT

A protective garment for a firefighter, a rescue worker, a chemical worker, or another worker working in a hazardous environment, has plural layers, each of which comprises a polymeric film that is fluid-impervious where not penetrated, which are not laminated, and which are detached from one another, except at seams at their boundaries and, possibly, if and where those layers are quilted. Spaces containing air only or containing an absorbent material are defined by those layers, in regions bounded by the seams. Whatever those spaces may contain, in regions bounded by the seams, those layers provide a wearer of the protective garment with redundant protection against fluid entry.

4 Claims, 1 Drawing Sheet

PROTECTIVE GARMENT HAVING NON-LAMINATED, LIQUID-IMPERVIOUS OR FLUID-IMPERVIOUS LAYERS, WHICH PROVIDE REDUNDANT PROTECTION

TECHNICAL FIELD OF THE INVENTION

This invention pertains to a protective garment, which is intended to be liquid-impervious or to be fluid-impervious, for a firefighter, a rescue worker, a chemical worker, or another worker working in a hazardous environment.

BACKGROUND OF THE INVENTION

Commonly, when working in a hazardous environment, which may be oxygen-deficient or which may expose occupants to toxins, pathogens, or other hazards, a worker wears a protective garment, which is made from sheets of liquid-impervious or fluid-impervious films or from sheets of liquid-impervious or fluid-impervious fabrics. Such protective garments are exemplified in U.S. Pat. No. 4,272,851, No. 4,864,654, and No. 6,364,980, which disclose suitable films, fabrics, and laminates and the disclosures of which are incorporated herein by reference.

Fluid-impervious means gas-impervious as well as liquid-impervious. If a film, fabric, or laminate meets the criteria of ASTM Test Method D 739-85, the film, fabric, or laminate is considered to be liquid-impervious. If a film, fabric, or laminate meets the criteria of ASTM Test Method F 903-84, the film, fabric, or laminate is considered to be fluid-impervious. Other methods may be instead used to determine whether a film, fabric, or laminate is liquid-impervious or whether a film, fabric, or laminate is fluid-impervious.

SUMMARY OF THE INVENTION

This invention improves an improvement in a protective garment, as described above, for a firefighter, a rescue worker, a chemical worker, or another worker working in a hazardous environment, in which the protective garment may become torn, snagged, or penetrated accidentally.

As improved by this invention, the protective garment has plural layers, each of which is impervious to liquids, gases, or both where not penetrated, and those layers are not laminated to one another but are detached from one another, except at seams at their boundaries and, possibly, if and where those layers are quilted. Hence, in regions bounded by the seams, those layers provide a wearer of the protective garment with redundant protection.

Preferably, spaces containing air only are defined by said layers, in regions bounded by said seams. Alternatively, spaces containing an absorbent material are defined by said layers, in regions bounded by said seams.

BRIEF DESCRIPTION OF THE DRAWINGS

FIG. 2 illustrates a non-quilted construction.

In FIG. 3, an absorbent material, which may be optionally provided, is illustrated in broke lines.

DETAILED DESCRIPTION OF THE ILLUSTRATED EMBODIMENTS

Figure 1:
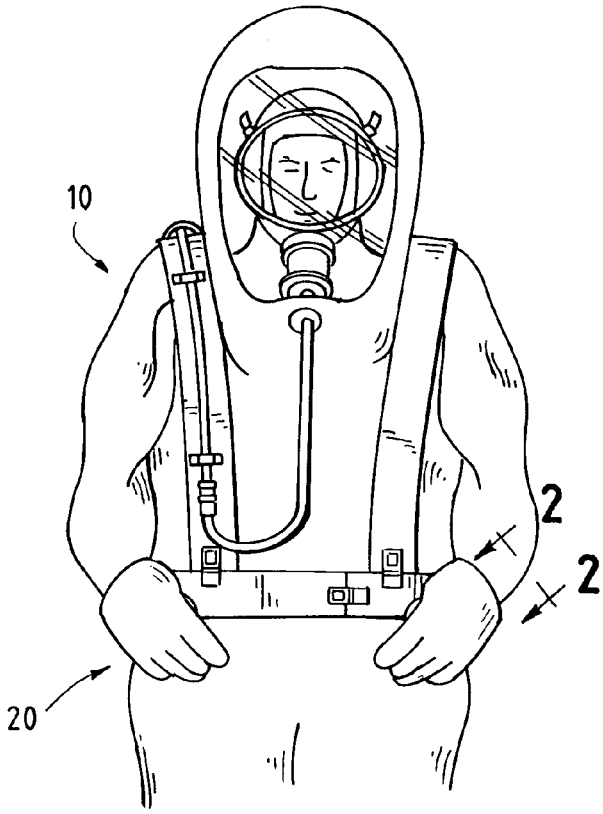
FIG. 1 is a perspective view of a firefighter wearing two protective garments embodying this invention, namely, a protective coat and protective pants.

As illustrated in FIG. 1, a firefighter is wearing protective gear including two protective garments embodying this invention, namely, a protective coat 10 embodying this invention and protective pants 20 embodying this invention. Rather than being embodied in a protective coat or in protective pants, this invention may be also embodied in a protective coverall.

Each protective garment 10, 20, has an outer layer 30, which is made from two sublayers laminated to one another, namely, an outer sublayer 32 of a suitable fabric, such as Nomex™ fabric used commonly in protective garments, and an inner 34 sublayer of a fluid-impervious, polymeric film or of a fluid-impervious, polymeric film composite, such as one of the films or film composites disclosed in U.S. Pat. No. 4,272,851, No. 4,864,654, and No. 6,364,980, supra. Each protective garment 10, 20, has an inner layer 40, which is made from two sublayers laminated to one another, namely, an outer sublayer 42, which is similar to the outer sublayer 32 of the outer layer 30, and an inner sublayer 44, which is similar to the inner sublayer 34 of the outer layer 30.

Figure 2:
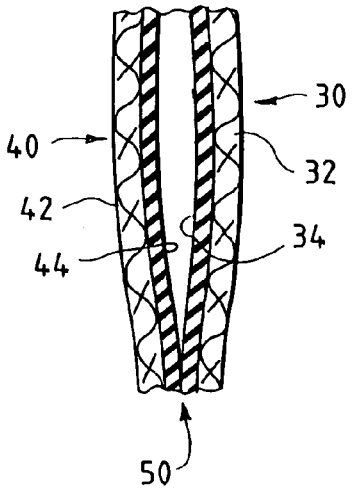
FIG. 2, on a greatly enlarged scale, is a sectional view, which is taken along line 2—2 of FIG. 1, in a direction indicated by arrows.
Figure 3:
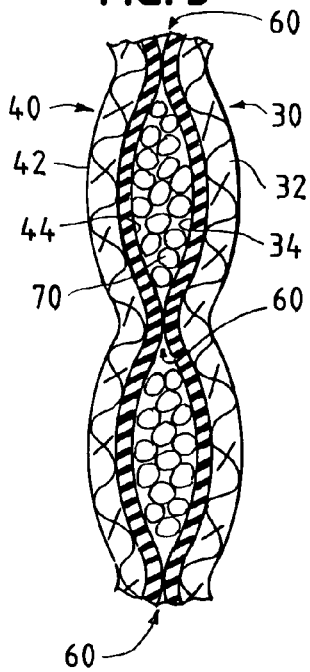
FIG. 3 is a similar, sectional view, which illustrates a quilted construction.

In each protective garment 10, 20, the outer layer 30 and the inner layer 40 are not laminated to one another but are detached from one another, except at seams 50 at or near their boundaries, which include the cuffs, collar, front edges, and bottom edges of the protective coat 10, which include the cuffs and waist edge of the protective pants 20, and except where the noted layers 30, 40, are quilted, if the noted layers 30, 40, are quilted. In FIG. 2, in which the noted layers 30, 40, are not quilted, an exemplary seam 50 is illustrated, near a cuff of the protective coat. In FIG. 3, in which the noted layers 30, 40, are quilted, exemplary seams 60 are illustrated, where the noted layers 30, 40, are quilted. If the seams 60 are sewn, the seams 60 are sealed with an adhesive sealant.

Spaces containing air only or containing an absorbent material 70, which may be optionally provided, are defined in regions 52 bounded by the seams 50, if the noted layers 30, 40, are not quilted, or in regions 62 bounded by the seams 60, if the noted layers 30, 40, are quilted. The absorbent material 70, if provided, may contain one or more of a cellulosic material, a superabsorbent polymer, and activated carbon. Whatever those spaces may contain, the noted layers 30, 40, provide a wearer of the protective garment with redundant protection against fluid entry. If the outer layer 30 becomes torn, snagged, or penetrated accidentally, the inner layer 40 may continue to protect a wearer of the protective garment 10, 20.

The invention claimed is:

1. In a protective garment for a firefighter, a rescue worker, a chemical worker, or another worker working in a hazardous environment, in which the protective garment may become torn, snagged, or penetrated accidentally, an improvement wherein the protective garment has plural layers, each of which is impervious to liquids, gases, or both where not penetrated, said layers being not laminated to one another but being detached from one another, except for seams at their boundaries and except where said layers are drawn together by closures, so that said layers, in regions bounded by said seams, provide a wearer of the protective garment with redundant protection, wherein each of said layers comprises a polymeric film or a sublayer of a polymeric film laminated to another sublayer, which may be a polymeric film.

2. In a protective garment for a firefighter, a rescue worker, a chemical worker, or another worker working in a hazardous environment, in which the protective garment may become torn, snagged, or penetrated accidentally, an improvement wherein the protective garment has plural layers, each of which is impervious to liquids, gases, or both where not penetrated, said layers being not laminated to one another but being detached from one another, except for seams at their boundaries, except where said layers are drawn together by closures, and except where said layers are quilted, so that said layers, in regions bounded by said seams, provide a wearer of the protective garment with redundant protection, wherein each of said layers comprises a polymeric film or a sublayer of a polymeric film laminated to another sublayer, which may be a polymeric film.

3. The improvement of claim 1 or claim 2, wherein spaces containing air only are defined by said layers, in regions bounded by said seams.

4. The improvement of claim 1 or claim 2, wherein spaces containing an absorbent material are defined by said layers, in regions bounded by said seams.

* * * * *